United States Patent [19]

Zimmerman

[11] 3,989,247

[45] Nov. 2, 1976

[54] RACKET BALL PICK-UP DEVICE

[76] Inventor: Eli Zimmerman, 129 W. 95th St., Apt. 2, New York, N.Y. 10025

[22] Filed: June 9, 1975

[21] Appl. No.: 585,395

[52] U.S. Cl. ..... 273/73 R
[51] Int. Cl.[2] ..... A63B 49/02
[58] Field of Search ..... 273/73 R, 73 C, 73 J, 273/74, 162 E; 294/19 A

[56] References Cited

UNITED STATES PATENTS

| | | | |
|---|---|---|---|
| 266,598 | 10/1882 | Alexander | 273/73 R |
| 1,994,207 | 3/1955 | Ahles | 273/162 E X |
| 2,628,804 | 2/1953 | Goodman | 273/74 |
| 2,788,630 | 4/1957 | Nisbet | 294/19 A X |
| 2,801,105 | 7/1957 | Acton | 273/73 R |
| 2,801,875 | 8/1957 | McEvoy | 273/162 E X |
| 3,306,649 | 2/1967 | Zagwyn | 273/162 E X |
| 3,318,628 | 5/1967 | White | 273/162 E X |
| 3,462,184 | 8/1969 | Russell | 273/162 E X |
| 3,712,658 | 1/1973 | Yaresh | 273/162 E X |
| 3,790,202 | 2/1974 | Nagel | 294/19 A |
| 3,922,027 | 11/1975 | Nesselt | 294/19 A |

FOREIGN PATENTS OR APPLICATIONS

| | | | |
|---|---|---|---|
| 501,523 | 11/1954 | Italy | 273/162 E |
| 799,947 | 8/1958 | United Kingdom | 273/73 R |

*Primary Examiner*—Richard J. Apley

[57] ABSTRACT

In a preferred embodiment of the invention, a clamp-on plastic arcuate element of C-shaped cross-section is provided for snapping-onto an upper portion of a tennis racket head frame, and continuous with and fused to substantially opposite ends of the arcuate element is a correspondingly arcuate semi-rigid substantially flexible lever element biased normally to a predetermined position in an open state away from the upper-most part of the tennis racket and arcuate element at a predetermined distance substantially less than a diameter of a tennis ball such that when the arcuate element is mounted on the tennis racket head frame the tennis racket by a person holding the handle thereof may be used as a pick-up device for retrieving tennis balls without any need of bending over or flexing the back, the arcuate base member also defining a substantially C-shaped pair of flanges as a part of an upper-most part of the arcuate element opposite the pick-up lever for anchoring the lever in a recessed lock-down position when in a closed state not in use as a pick-up device.

10 Claims, 19 Drawing Figures

RACKET BALL PICK-UP DEVICE

This invention relates to a novel tennis racket accessory for picking-up a tennis ball by use of a tennis racket as an elongated lever.

BACKGROUND TO THE INVENTION

Heretofore there have been no provisions whereby people of advanced age or people with back infirmities or knee or leg-muscle problems may avoid repeated stooping and/or bending to retrieve tennis balls, and accordingly such people have been discouraged because of such necessity from playing tennis which otherwise could be of substantial healthful value both emotionally and physically.

SUMMARY OF THE INVENTION

Accordingly, objects of the present invention are directed to overcome difficulties and disadvantages heretofore faced by such tennis players, together with the providing of novel and advantageous tennis racket accessory(ies) and new designs of tennis rackets which have structure incorporating fixedly such accessory(ies), as an integral part of the tennis racket.

Another object is to obtain a tennis racket detachable accessory utilizable with already personally selected racket(s) of a person's choice by an individual tennis player, providing for convenient pick-up of the tennis ball.

Another object is to provide a tennis racket accessory characterized by perfection in design avoiding interference with a tennis game intermittently between use of such device for tennis-ball picking-up purposes.

Another object is to obtain a tennis racket incorporating a tennis ball pick-up accessory or mechanism utilizable of convenient opening and closing mechanisms which do not interfere with the use of the racket in the conventional playing of the tennis game.

Other objects become apparent from the preceding and following disclosure.

One or more objects are obtained by the invention defined herein.

Broadly the invention may be defined as a tennis or other ball-pickup device, utilizable in association with a racket having a handle of the racket as a lever, preferably in the nature of a tennis racket in which the pick-up device is associated with the head of the tennis racket in a manner which avoids interference with the playing of the tennis game, while by the nature of its specific design being highly efficient in the utilization of the tennis racket for retrieving a tennis ball easily and rapidly during the course of the playing of a tennis game. In one basic embodiment of the invention, the pick-up device is a detachable device in the nature of a snap-on arcuate base element having a substantially C-shaped clamp-on cross-section clampable around the outer end portions of a tennis racket head frame. In a more preferred embodiment, the composition of snap-on base is of a substantially firm but flexible composition of plastic or rubber or the like, possibly of fiberglass, having a pick-up lever also of a correspondingly arcuate shape anchored preferably by a fusion of the opposite ends thereof with a base support arcuate element at opposite ends of the arcuate member (element), such that when not in a locked-down position the upper most mouth portion of the pick-up lever is biased to a pick-up open-state position located a distance slightly less than a diameter of a tennis ball, and preferably the arcuate base member includes characteristically C-shaped paired flange members integral with and extending from an upper-most part of the arcuate element as a support base such that the pick-up lever is susceptable of being snapped-retainably thereinto into a locked down position, flush with a face or top of the racket head frame in an out-of-the-way location during tennis play with the racket but easily flipped to an open position by insertion of a finger into a cut-out portion of the arcuate element itself.

In another embodiment, the pick-up lever is anchored at opposite ends thereof by threading through one or more slits in and at opposite ends of the arcuate element, and preferably a proximal end of the lever is inclusive of a bent portion and a distal end is also inclusive of a bent portion, and the proximal end including spaced-apart arcuate flanges extending in about opposite directions substantially transversly to a longitudinal elongated axis of the pick-up lever, whereby in a mounted state on the base member extending through one or more slits thereof in an anchoring fashion, the arcuate pick-up lever is biased into a pick-up opened-state position defining a wedge-pickup space at an intermediate point of the pick-up lever, between the lever and the racket head frame or base member (arcuate element) mounted thereon, substantially less than a diameter of a tennis ball, and in this embodiment, as in the prior described embodiment, there is provided preferably a lock-down flanges-combination preferably jointly also defining a C-structure into which the pick-up lever may be pressed retainably and lockably when not in use as a pick-up device for retrieving tennis balls. In this particular embodiment, the pick-up lever is preferably of a metallic composition, but not necessarily, being possibly of a semi-rigid but substantially flexible material such as polypropylene or the like.

In a still further embodiment of the invention, the pick-up lever has as a supporting base a tennis racket itself onto which the lever is mounted in association with a biasing spring preferably biasing the tennis racket lever inwardly to a closed state with sufficient biasing action as to substantially retain the racket pick-up lever in a closed state when not in use, and including lever-opening mechanism associated preferably with and along the handle whereby the pressing or turning of the lever portion which is the pick-up lever, to an open and locked-open (preferably) state, and a reverse movement of the lever permitting a spring-biasing closing of the lever after completion of the ball picking-up procedure. The actuation levers associated with the handle(s) are so-located as to be of little or no consequence or interference in so far as normal and conventional playing of the game, but such that convenience is provided for the actuation of the lever for the opening of the pick-up device without materially interrupting the play of the tennis game. In one such embodiment, a button associated with and adjacent an upper portion of the handle is pressible downwardly by the thumb, for example. In another such embodiment, a gear engageable lever portion located at the base of the handle grip is movable axially to engage with the gears and is turnable of the gears in either clock-wise or counter-clockwise directions, as the case may be per the construction mechanism, to open and in an opposite direction to close the pick-up lever before and after its use for purposes of retrieving a tennis ball. Also in preferred embodiments of the invention, the mounting base and/or the tennis racket itself, includes a recess along a circumscribing surface of a tennis racket head frame receivable of flushly the pick-up lever in a snap-down locked use intermediate between pick-up uses, such that during play the pick-up lever is not capable of reasonably interfering with the normal playing of the tennis game with the racket.

The invention may be better understood by making reference to the Figures as follow.

THE FIGURES

Figure 2:
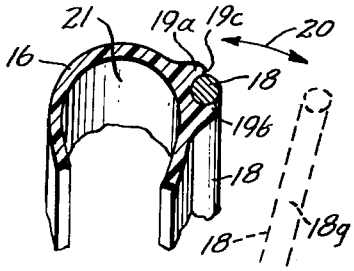
FIG. 2 illustrates an in-part cross-sectional view as taken along lines 2—2 of FIG. 1, also illustrating relative open pick-up position of the pick-up lever relative to the supporting base thereof.
Figure 6:
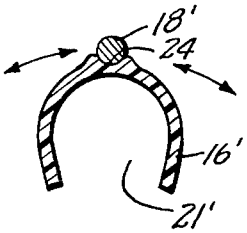

FIG. 6 illustrates a side cross-sectional view comparable to that of FIG. 2 of an alternate embodiment of the invention in which the pick-up lever is seatable within a recess locking structure of the supportbase where the recess is located at the upper most portion of the base member and thereby making possible the movement of the pick-up lever in either of opposite directions relative to the support base and to a tennis racket on which the support base would be mounted.

Figure 7A:
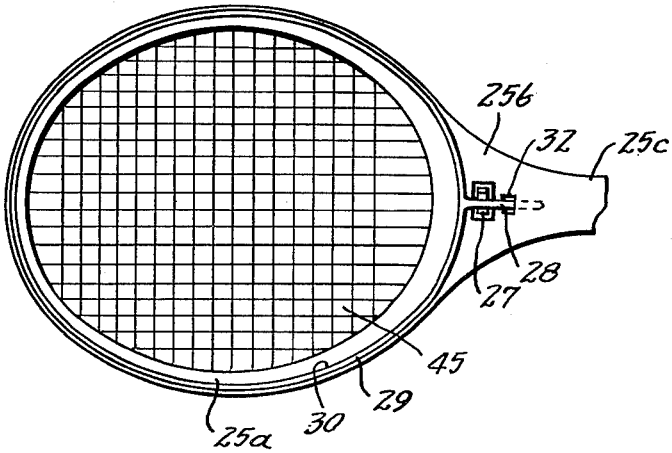
Figure 7:
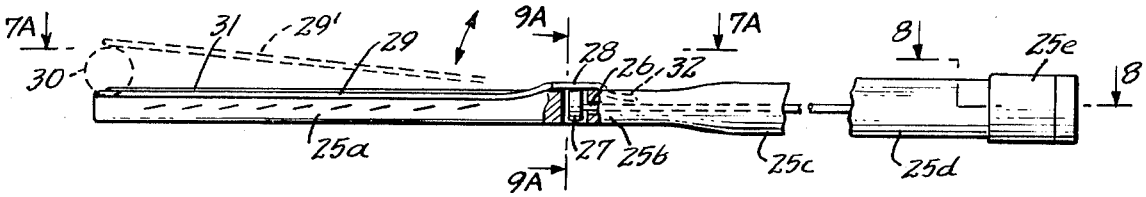

FIG. 7 illustrates a side view of a tennis racket embodying a pick-up device in accord with one embodiment of the present invention, also illustrating the position of the pick-up lever and of a tennis ball being picked-up thereby.

FIG. 7A illustrates an elevation plan view as taken along lines 7A—7A of FIG. 7.

Figure 8:
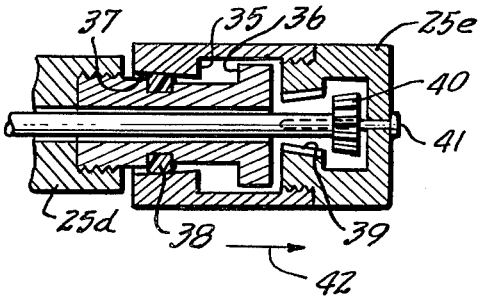

FIG. 8 illustrates an elevation cross-sectional view as taken along lines 8—8 of the handle of the embodiment of the FIG. 7, illustrating a gear-type mechanism for the actuation lever of the embodiment of FIG. 7.

Figure 9A:
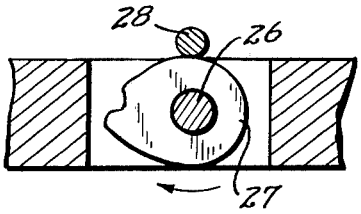
Figure 9B:
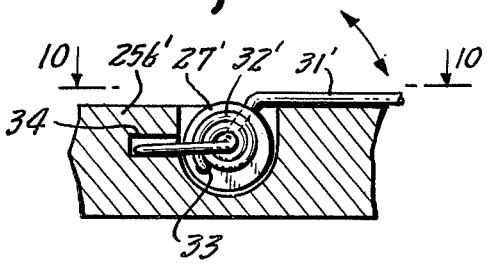
Figure 9:
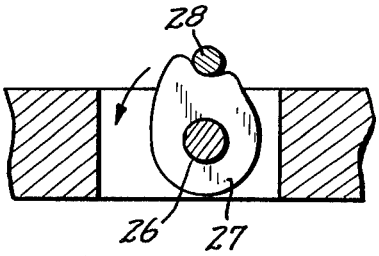

FIG. 9A illustrates a view as taken along the cut-away illustrative portion of FIG. 7, illustrating in cross-sectional view in the closed state a position of an eccentric rotatable disk element fixedly mounted on an end of the rotatable shaft extending from the handle and actuatable by the turning of the handle actuation lever when engaged, such that the pick-up lever snaps-in and is locked temporaryily and intermittently into an open position as illustrated in the FIG. 9 view.

FIG. 9 illustrates the same mechanism, as that of FIG. 9A as it would appear in cross-section, when the actuation lever is twisted to a locked-open state as it would be viewed similarly along line 9A—9A except in an open state.

Figure 10:
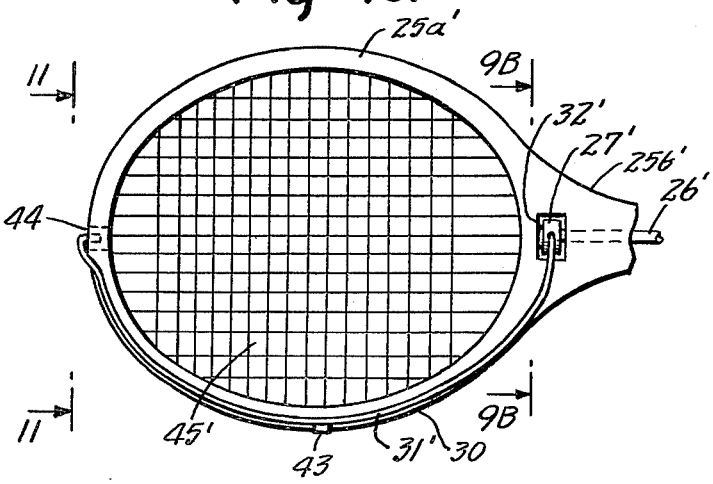

FIG. 9B illustrates an alternate embodiment comparable to that of FIG. 9, in which a spring is anchored within the wood of a racket, and an opposite end of the spring is anchored into the disk mounting a pick-up rod(lever) centrally thereof extending toward the handle, and mounting on its periphery a pick-up lever as illustrated in FIG. 10, as taken along lines 9B—9B of FIG. 10.

FIG. 10 illustrates a view as taken along lines 10—10 of FIG. 9B, in an elevation plan view of the embodiment of FIG. 9B in an in-part view of a tennis racket illustrates the particular position of the pick-up lever in this embodiment where the lever extends around one edge of the tennis racket and is recessed within a seat-groove while also having preferably a locking device located along the edge of the racket frame.

Figure 11:
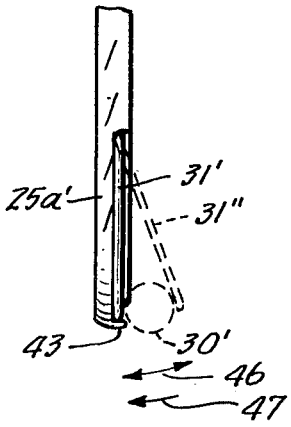

FIG. 11 illustrates a view of the embodiment of FIG. 10 as taken in an in-part view along lines 11—11 of FIG. 10, also illustrating the pick-up lever in phantom in an open state and a ball wedged into position also shown in phantom.

Figure 12:
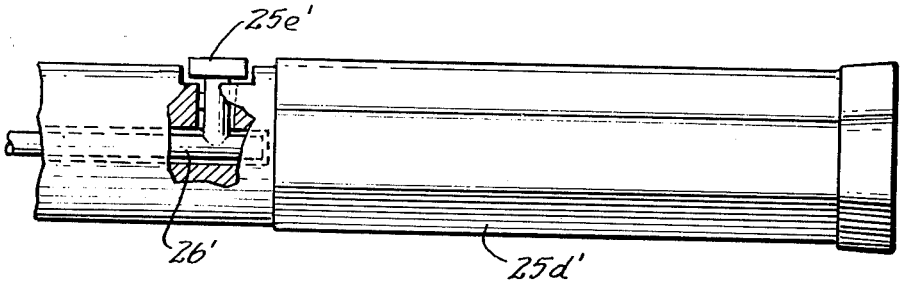

FIG. 12 illustrates an embodiment shown in typically an elevation plan view as an alternate to the actuation handle arrangement of FIG. 7 embodiment. This is also an in-part view directed solely to the actuation mechanism handle of a tennis racket.

Figure 1:
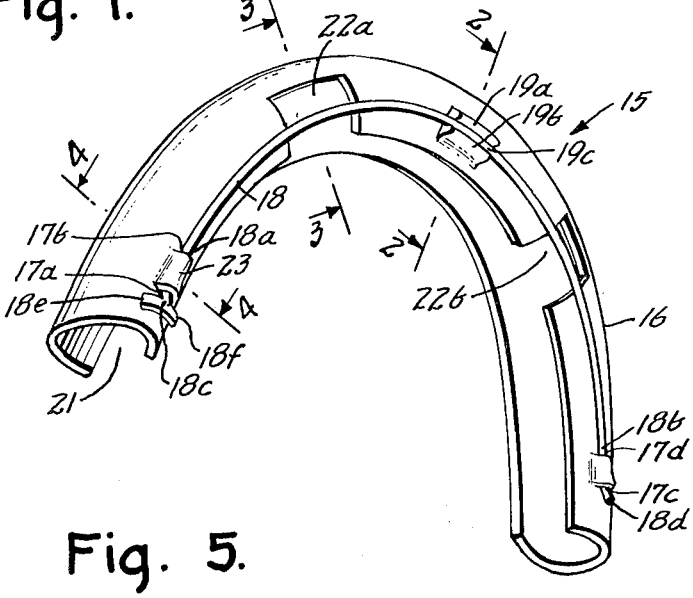
FIG. 1 illustrates a side perspective view of a typical attachable tennis racket accessory pick-up device of the present invention.
Figure 13:
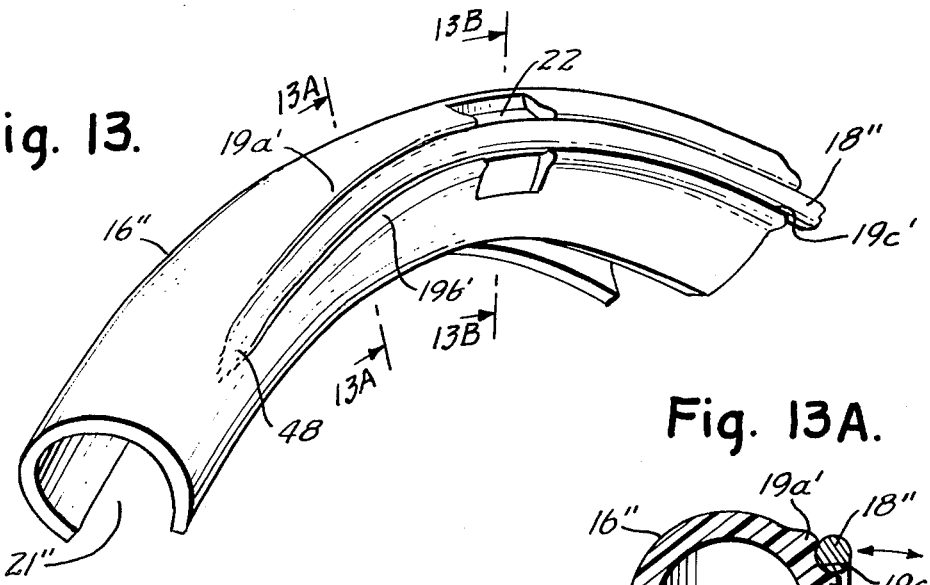

FIG. 13 illustrates a preferred embodiment of the invention of a detachable clamp-on base member shown in an in-part view in perspective side view comparable to the view of FIG. 1, except in this embodiment the pick-up lever being fused with the clamp-on base support structure.

Figure 13A:
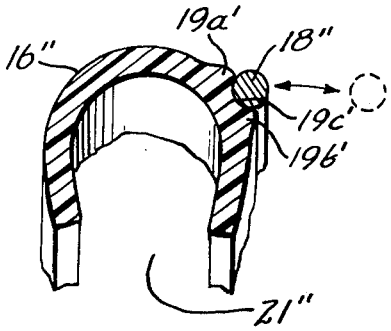
Figure 13B:
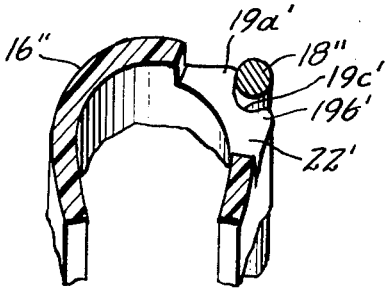

FIG. 13A illustrates a view of the embodiment as taken along lines 13A-13B of FIG. 13, illustrating the recessed structure-nature of the embodiment whereby the pick-up lever in a closed state is held in a manner as illustrated in the alternate view of FIG. 13B in a locked-state as viewed through a cut-away portion of the base support member through which a finger may be inserted to force the pick-up lever to an unlocked location.

Figure 14:
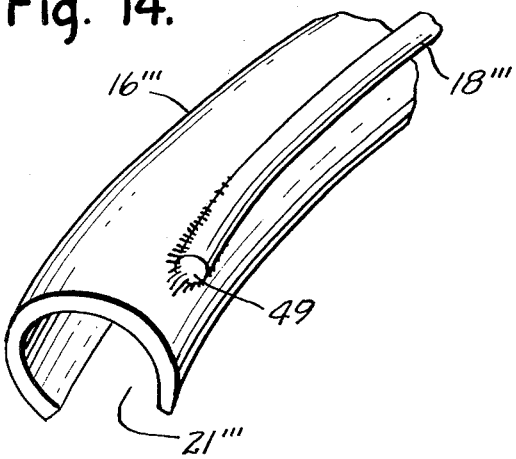

FIG. 14 illustrates an embodiment substantially comparable to that of FIG. 13, in a similar in-part perspective view, in which the separate pick-up lever is fused to a support base such as that of FIG. 1 embodiment.

DETAILED DESCRIPTION OF THE INVENTION

Figure 3:
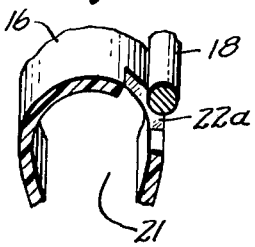
FIG. 3 illustrates a view comparable to that of FIG. 2 but along line 3—3 as taken through the cut-away finger-opening portion of the device of FIGS. 1 and 2.
Figure 4:
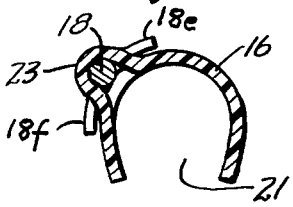
FIG. 4 illustrates a further view as taken through the anchoring mechanism of the embodiment of FIG. 1 as taken along the lines 4—4 of FIG. 1 in cross-section.

FIGS. 1 through 5 illustrate a common typical embodiment of the present invention, as a tennis racket head-snap-on integral unit 15 including a preshaped typically plastic mounting base 16 shaped to fit the semi-circular shape of the racket head frame at an upper end thereof, and shaped to fit clampingly around the body of the frame by virtue of what in transverse cross-sections of FIGS. 2, 3, and 4 appears as a C-shape. The mounting base 16 includes slits **17*a*, 17*b* at one terminal end and 17*c*, 17*d* at an opposite terminal end, such that the elongated clamping lever structure 18 may be and is threaded through, downwardly through 17*a*, and back outwardly to exterior space by virtue of 17*b* and inwardly through 17*d* and outwardly through 17*c*. The element 18 includes a bend at each of 18*a* and 18*b* preferably, thereby defining opposite ends 18*c* and 18*d*, the end 18*c* having flanges 18*e* and 18*f* of downwardly curved concave arcuate shape; these bends and shapes are functional, the bends 18*a* and 18*b* being such that when the element 18 is not locked into a closed position shown best in FIG. 2 locked between lips 19*a* and 19*b* within recess 19*c*, in the non-locked state the bends cause the central portion of the element 18 to assume an outwardly biased position and state as indicated by 18*g* in phantom in FIG. 2. The flange 18*e* serves to prevent the element 18 from twisting in a counter-clockwise direction in the views of FIGS. 1–3 which would be clockwise in FIG. 4 view, and flange 18*f* serves to prevent twisting in a clockwise direction in FIGS. 1–3 or counter-clockwise direction in FIG. 4 views, respectively. When pressing the element into a locked position of FIG. 2 for the element 18, there would be a tendency for the element to twist; by virtue of the flange 18***e*, the central portion of the element 18 at the locked position of FIG. 2 is thereby spring-biased outwardly, and whenever the central portion of the element 18 is pressed outwardly beyond the non-biased position 18*g* of FIG. 2, the element being pressed outwardly whenever a tennis ball is wedged between the element 18 and the support base 16(mounting base), the flange 18*f* causes the central portion of the element 18 to be biased inwardly toward the position 18*g* of FIG. 2.

The mounting base accordingly mounts the element 18 for movement in directions 20 and also forms recess space 21 into which a tennis racket head's upper portion may be snapped retainably.

FIG. 3 illustrates in cross-sectional transverse view along line 3—3 of FIG. 1 embodiment, the cut-out portion 22*a* provided for easy insertion of a person's finger, similarly the position 22*b* would be for alternate insertion of a finger, such that the central portion of the element 18 may be wedged outwardly from the locked state and position illustrated in each of FIG. 1 and FIG. 2.

FIG. 4 in cross-section transversly along lines 4—4 of FIG. 1, shows the position of the element 18 as it extends between slits 17*a* and 17*b* beneath the intermediate strip(between slits 17*a* and 17*b*) 23 which is a part of the mounting base 16. In this view, also the flanges 18*e* and 18*f* are visible, arced along the outer curved surface of the mounting base 16.

Figure 5:
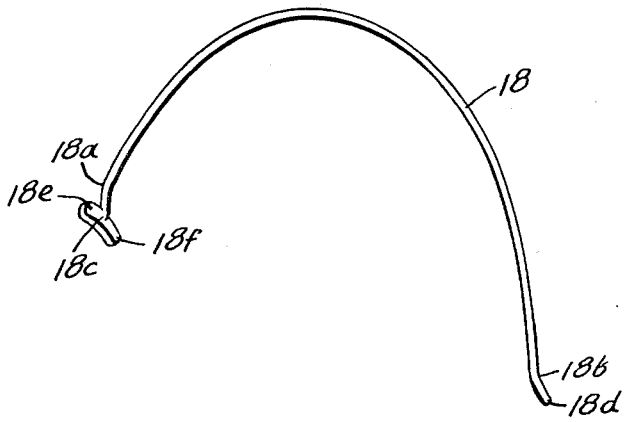
FIG. 5 illustrates a side perspective view of solely the pick-up lever itself, of the embodiment of FIG. 1.

FIG. 5 illustrates the element 18 in an unmounted state, for purposes of better illustrating the overall shape of this lever structure.

FIG. 6 illustrates an alternate embodiment which would correspond substantially to that of FIGS. 1 through 5 except that the locking lips or flanges of the mounting base are on the upper-most surface defining recess 24 into which is locked an element 18′ which may be unlocked to flip outwardly in either direction of the racket upper frame and the mounting base; the flanges would be altered such that opposite flanges would bias the element 18′ toward the central locked position shown in this as shown in FIG. 6 for the mounting base 16′ defining the snap-in recess 21′ for receiving the upper end portion of a tennis racket head frame.

FIGS. 7A, and 7 and 8 and 9 and 9A all illustrate varying views of a common embodiment, FIG. 7A being an in-part view as taken along lines 7A—7A, FIG. 8 an in-part top-cross-sectional view along lines 8—8, and FIG. 9A a transverse in-part cross-sectional and in-part elevation axial view along lines 9A—9A, for the embodiment shown in elevation plan side view in FIG. 7. In this embodiment of the invention, the pick-up mechanism is mounted on, integral with the frame-handle structure itself, pivoting in the same upward direction as for the FIG. 1 embodiment. Accordingly there is disclosed a tennis racket head frame structure 25*a*, neck structure 25*b*, elongated handle-lever structure 25*c*, and the terminal end handle structure 25*d*, with regard to different integral portions of the overall tennis racket structure. Further is the handle total general structure 25*e* shown best in FIGS. 7 and 8, as it would appear in a typical embodiment thereof. Lever shaft 26 extends through a channel in the neck structure 25*b*, the handle-lever structure 25*c*, terminal end handle structure 25*d*, into a female gear recess of total general structure 25*e* at one end of the shaft, and into the clamping structure element 28—recess of the neck structure 25*b* at the other opposite end of the shaft 26. At the handle end, male gear of bevel-shape and annular shape is mounted around the end of the shaft 26 such that gear teeth thereof are engageable with female gear teeth 39 of the total general structure 25*e* when the total general structure 25*e* is moved in a slipping manner axially in direction 42 such that gears (gear teeth) engage after the wedge-angled portions 37 are forceably slipped from a wedged pushed-in position on the typically plastic (semi-resilient, for example) such as Teflon, as shown in the wedged non-engaged gear position in FIG. 8. The stepped abuttment face 35 spaced from the stepped abuttment face 36 becomes engaged when the total general structure 25*e* is forceably moved in direction 42 thereby preventing the total general structure 25*e* from slipping beyond and possibly off-of the central channel structure around which it is mounted. The plastic member 38 preferably is annular, extending around and mounted on the racket terminal end handle structure 25*d*, within a notched-out recess. The pin 41 typically centers the gear 40, and the teeth 39 are angularly inclined to mesh with the beveled gear teeth of gear 40 preferably. The shaft 26 as shown in FIGS. 7 and 9A has an eccentric seating and wedge disk 27 mounted thereon with the lever structure 28 mounted within recess 37 of FIG. 7A and such that the lever structure 28 is always biased downwardly against the surface of the disk 27 as shown in FIGS. 9 and 9A. For FIG. 9A, and with reference to FIG. 8, when the FIG. 8 total general structure 25*e* is pulled axially outwardly to engage the gear teeth discussed above, and thereafter is rotated such that the disk as viewed in FIG. 9A moves in a clockwise direction as shown by the arrow of that FIG. 9A, with the result that the lever structure 28 is pressed upwardly to the FIG. 9 illustrated position with the element lever structure 28 resting in a stable seated position at which the lever structure will remain open in the position shown in phantom in FIG. 7 until thereafter the total general structure is rotated in an opposite direction back to the position shown in FIG. 9A by rotation of the disk in the direction as illustrated in FIG. 9.

For the different embodiment of FIGS. 9B, 10, 11 and 12, the racket neck 25*b′* and handle-lever structure, and channel therethrough and the shaft 26′ substantially correspond to the preceeding embodiment, except having, in elevation plan view, push-button 25*e′* for rotation of the shaft 26′ by pushing downwardly on the push-button 25*e′* as with thumb pressure, for example, such that the lever structure 31′ is movable upward in the direction shown from its downwardly biased position of FIG. 9B as the mounted disk 27′ becomes rotated counter-clockwise as viewed in FIG. 9B, against biasing action of spring (spiral) element 32′ mounted at one end in disk aperture 33 and at an opposite end in recess 34 of the neck structure 25*b′*, the lever structure 31′ being mounted within a outer circumscribing surface aperture of the disk 27′. In a preferred embodiment of this particular racket embodiment of the invention, the side-wardly opening lever structure as shown best in FIGS. 10 and 11, is seated within a recess seat 30, and FIG. 11 illustrates in phantom the ball 30′ wedged between the seat 30 and the outwardly-forced lever structure positioned as position 31'', thus movable in directions 46, but biased in direction 47. Preferably the lever structure is wedge locked(detachably) by wedge element 43 typically, such that finger pressure on lever push-button 25*e'* forceably lifts the lever structure to the 31'' position and state for receipt wedgeably of a tennis ball 30'. The lever structure 31' is mounted on the disk 27' within the recess 32' of the neck structure 25*b'*.

FIGS. 13, 13A, and 13B illustrate an alternate embodiment to but substantially the same as that of FIG. 1, in which the mounting structure 16'' is preformed with a recess groove formed by gradually heightened side projections or lips as shown in the FIG. 13A illustration as lips 19*b'* and 19*a'* defining seat 19*c'* for element 18'' and snap-in recess 21'', with the element 18'' being integrally fused at each of opposite ends to the mounting structure 16'' at fusion points such as fusion point 48, movable in the direction indicated by the arrow to the phantom illustrated position, and as shown in FIG. 13B locks between the high lips (at that position) 19*b'* and 19*a'*, with the aperture 22 being preferably (as shown) adjacent the locking flanges thereby making the finger-unlocking of the element 18'' easier — less force being required at this point since there would be no opportunity for the element 18' to bend before unlocking from its wedged position.

FIG. 14 illustrates an alternate embodiment to that of FIGS. 1 and 13, differing only basically in that the lever structure 18''' includes a fused portion 49 fusing with the mounting base 16''' which forms a snap-on recess 21''', such that the lever structure 18''' is always biased toward a predetermined position and state as might be desired, there being not shown locking structure which is optional as in the other embodiments.

However, locking structure is desired normally to prevent the possibility of the lever structure from becoming opened in its state of being, during tennis play of a game, such that the playing of the game would be interfered with.

It is within the scope of the present invention to make such variations and modifications and substitution of equivalents as would be apparent to a person of ordinary skill.

I claim:

1. A racket ball pick-up device comprising in combination:

support means comprising a racket head and a handle extending therefrom, for supporting a spring-biased lever structure on said racket head, and a spring means comprising said lever structure mounted on the racket head in a position adjacent and in opposing relationship to said racket head, said spring means further comprising means for permitting selective closing and opening of said lever structure whereby when said lever structure is in said open position at least a central ball wedging portion thereof is spaced from said racket head a predetermined distance slightly less than the diameter of the ball to be picked up.

2. A racket ball pick-up device of claim 1, in which said support means further comprises a base support means for detachably clamping onto said racket head, the spring means being mounted on the base support means and spring-biasing said lever structure into said open and closed positions.

3. A racket ball pick-up device of claim 2, in which the base support means includes a substantially arced element shaped along an elongated axis thereof to correspond substantially to an upper end of said racket head and in cross-section across and substantially transverse to the arced element and its elongated axis the arced element being substantially C-shaped and of a size suitable for clamping around an upper end of said racket head.

4. A racket ball pick-up device of claim 3, in which the spring means further includes at least one slit at each of opposite end portions of the arced element for receiving the opposite ends of the pick-up lever.

5. A racket ball pick-up device of claim 4, in which the lever structure includes an arc substantially corresponding to an arc along the elongated axis of said arced element and in which the lever structure at one end thereof is substantially of uniform shape as the main portions of the lever structure centrally thereof, said spring means further comprising wing flanges on an opposite end portion of said lever structure which when held against the outer surface of said arched element substantially centered the main portions of said lever structure at said predetermined distance, and a plurality of said slits being located such that said lever structure is positioned in said open state at said predetermined distance, said arced element being composed of substantially resilient material such that while within the slits the lever structure may be forced to a closed locking position.

6. A racket ball pick-up device of claim 3, in which the spring means further includes said lever structure fused fixedly at opposite ends thereof to said base support means arced element and the lever structure being mounted to extend to said predetermined distance in an open state and further being composed of a substantially resilient material such that it is flexible to and from a wedge ball-retaining position and a closed and locked state position against the arced element.

7. A racket ball pick-up device of claim 6, in which the outer surface of said arced element defines a concave recess extending along its elongated axis located at a point opposite of and recessedly seatable of the lever structure.

8. A racket ball pick-up device of claim 1, in which the lever structure includes an arc substantially corresponding to an arc along the elongated axis of said arced element, and in which the arced element includes as a part thereof spaced-apart arced flanges arced toward one-another and spaced at outer ends thereof a distance less than a width of said lever structure at a location opposite the spaced-apart arced flanges such that the arced element is forceable between the outer ends to be retainably locked between the spaced-apart arced flanges.

9. A racket ball pick-up device of claim 1, in which said support means biases said lever structure toward a closed-state position at which the lever structure is pressed flushly against said racket head frame, and further including lever means for opening said lever structure to said predetermined open position.

10. A racket ball pick-up device of claim 9, said lever means further including a rotatable wedge element of arcuate eliptical shape and a rod fixedly mounting the rotatable wedge element, the rod being mounted rotatably with the rotatable wedge element positioned beneath the lever structure at a point adjacent its pivotal mounting on said tennis racket head such that rotation of said rotatable wedge wedges the lever structure into said open position and state.

* * * * *